US009786160B2

(12) United States Patent
Sun

(10) Patent No.: US 9,786,160 B2
(45) Date of Patent: Oct. 10, 2017

(54) INTERIOR DISTRIBUTING SYSTEM AND METHOD FOR THE SAME

(71) Applicants: Artinfac Technology Corp., Hsinchu County (TW); Sitronix Technology Corp., Hsinchu County (TW)

(72) Inventor: Shih-Chiang Sun, Hsinchu County (TW)

(73) Assignees: ARTINFAC TECHNOLOGY CORP., Hsinchu County (TW); SITRONIX TECHNOLOGY CORP., Hsinchu County (TW)

( * ) Notice: Subject to any disclaimer, the term of this patent is extended or adjusted under 35 U.S.C. 154(b) by 0 days.

(21) Appl. No.: 15/061,034

(22) Filed: Mar. 4, 2016

(65) Prior Publication Data

US 2016/0284209 A1 Sep. 29, 2016

(30) Foreign Application Priority Data

Mar. 26, 2015 (TW) ..... 104109755 A

(51) Int. Cl.
*G08C 17/02* (2006.01)
*G08C 23/04* (2006.01)
*G08C 19/00* (2006.01)

(52) U.S. Cl.
CPC ..... *G08C 17/02* (2013.01); *G08C 19/00* (2013.01); *G08C 23/04* (2013.01)

(58) Field of Classification Search
None
See application file for complete search history.

(56) References Cited

U.S. PATENT DOCUMENTS 7,003,084 B2 * 2/2006 Yoon ..... H04L 12/2803 379/102.01
7,639,907 B2 * 12/2009 Elberbaum ..... G08C 17/02 385/15
7,701,331 B2 * 4/2010 Tran ..... G07C 9/00309 340/5.7

FOREIGN PATENT DOCUMENTS

CN 101641870 A 2/2010
CN 203338121 U 12/2013
TW M359878 6/2009

* cited by examiner

*Primary Examiner* — K. Wong
(74) *Attorney, Agent, or Firm* — Chun-Ming Shih

(57) ABSTRACT

An interior distributing system includes a remote control, a controller, and at least one home electrical appliance. The remote control includes at least one buttons, and the button is used for triggering an corresponding operation command. The controller receives the operation command of the remote control. The home electrical appliance is located within a control area able to receive signals from the controller. While the controller receives the operation command of the remote control, the controller transmits the operation command to the home electrical appliance and the home electrical appliance performs a process task in response to the operation command.

13 Claims, 5 Drawing Sheets

INTERIOR DISTRIBUTING SYSTEM AND METHOD FOR THE SAME

CROSS-REFERENCE TO RELATED APPLICATIONS

This non-provisional application claims priority claim under 35 U.S.C. §119(a) on Taiwan Patent Application No. 104109755 filed Mar. 26, 2015, the entire contents of which are hereby incorporated by reference.

BACKGROUND

Technical Field

This disclosure is directed to an interior distributing system and a method for the same, and more particularly, to a smart remote control system a controller.

Related Art

Traditionally, the way to turn on or off a home electrical appliance is via a manual power switch. A user has to walk to the home electrical appliance and then operates the power switch by his/her hand. As the development of the human-system interface technology, more and more smart switching methods and devices are developed and researched.

Moreover, switching methods and devices without signal transmission lines are also developed, so as to simplify the wiring works of the interior decorating, in particular to refine of the interior. Switching methods and devices without signal transmission lines provide benefits of humanization, simple installation, and elegant and secure environment.

In the related arts, a remote control or a control center is used generally so far. Usually, a remote control can only control a power switch placed within the area of signal receiving range in the same region or same room, and the remote control can only be used to control one group of home electrical appliances to be controlled in a pre-determined region or room. This remote control is unable to be used on different group of home electrical appliance s to be controlled in the other region or room. Therefore, there is another problem to manage the remote controls with the paired groups. To the control center, the number of the home electrical appliances to be controlled can be easily changed by changing the setting of the control center. However, it is more difficult to assemble or set such a controlling system. Usually, the location of the control center is fixed; that is, the user can only operate this control center at a fixed location, and this location is not easy to be changed due to the restriction of the wiring works of the interior decorating.

Another approach is to combine the control center and remote control. The remote control is used to send operation command to the control center, and the control center controls the home electrical appliances. However, the same problem is that the remote control cannot be used to control different group of home electrical appliance s to be controlled in the other region or room. In this approach, managing the remote controls with the paired groups is still a problem.

Therefore, the home electrical appliance in the art can only be operated the home electrical appliances within the signal receiving range in a same region or room together and are unable to complete a one-to-many operation. In view of the above problem, an object of this disclosure is directed an interior distributing system and a method for an interior distributing system to solve the problem the prior art, providing an easy and human operation.

SUMMARY

Accordingly, this disclosure is directed an interior distributing system and a method for an interior distributing system. In this disclosure, a control center is used to achieve a one-to-many control, instead of instructing the home electrical appliances directly by a remote control directly by a synchronous operation or a grouping operation, so as to achieve the requirement of a stable system and easy operation thereof.

The interior distributing system of this disclosure includes a remote control, a controller, and at least one home electrical appliance. The remote control includes at least one button for triggering a operation command. The controller receives the operation command from the remote control. The home electrical appliance is located within a control area able to receive signals from the controller transmits. Wherein while the controller receives the operation command from the remote control, the controller transmits the operation command to the home electrical appliance, and the home electrical appliance performs a process task in response to the operation command.

In one or more embodiments, the operation command is a command that the controller communicates with and controls the home electrical appliance.

In one or more embodiments, the button is a mechanical button or a touch button.

In one or more embodiments, a data interchange is completed between the remote control and the controller via wireless transmission.

In one or more embodiments, a data interchange between the remote control and the controller is completed via wireless transmission, and the data includes operation status of the home electrical appliance.

In one or more embodiments, a data interchange is completed between the remote control and the controller via infrared rays, touch sensors or plug-in connection.

In one or more embodiments, the control area is defined by signal receiving range of the home electrical appliance from controller.

In one or more embodiments, the control area can be expanded via a repeater.

In one or more embodiments, the home electrical appliance is a power switch, a power socket or an electrical device on a loop of electricity supply.

In one or more embodiments, the connection and the transmission between the home electrical appliance and the controller are via wireless transmission, infrared rays or power lines.

This disclosure discloses another interior distributing system, which includes a remote control, a controller, at least one home electrical appliance, and a radio frequency sensor. The remote control includes a radio frequency identification tag and at least one button, the button is used for triggering an operation command. The controller receives the operation command from the remote control. The home electrical appliance is located within a control area able to receive signals from the controller. The radio frequency sensor is disposed within the control area for detecting the radio frequency identification tag. Wherein while the radio frequency sensor detects the radio frequency identification tag of the remote control, the controller transmits the operation command to the home electrical appliance, and the home electrical appliance performs a process task in response of the operation command.

In one or more embodiments, the operation command is a command that the controller communicates with and controls the home electrical appliance.

In one or more embodiments, the button is a mechanical button or a touch button.

In one or more embodiments, a data interchange is completed between the remote control and the controller via wireless transmission.

In one or more embodiments, a data interchange between the remote control and the controller is completed via wireless transmission, and the data includes operation status of the home electrical appliance.

In one or more embodiments, a data interchange is completed between the remote control and the controller via infrared rays, touch sensors or plug-in connection.

In one or more embodiments, the control area is defined by signal receiving range of the home electrical appliance from controller.

In one or more embodiments, the control area can be expanded via a repeater.

In one or more embodiments, the home electrical appliance is a power switch, a power socket or an electrical device on a loop of electricity supply.

In one or more embodiments, the connection and the transmission between the home electrical appliance and the controller are via wireless transmission, infrared rays or power lines.

A method for an interior distributing system, includes the following steps:

synchronizing a remote control and a controller; wherein the remote control includes a plurality buttons for being pressed to trigger corresponding operation commands; and grouping the remote control and the home electrical appliance;

when one of the buttons that corresponds a power-on operation command is pressed and the controller receives the power-on operation command, turning on the home electrical appliance by the controller; and when one of the buttons that corresponds a power-off operation command is pressed and the controller receives the power-off operation command, turning off the home electrical appliance by the controller.

In one or more embodiments, the step of synchronizing the remote control and the controller is to complete a data interchange between the remote control and the controller via infrared rays, so that the controller is able to confirm the validity of the operation command transmitted from the controller.

In one or more embodiments, the step of grouping the remote control and the home electrical appliance is to complete a data interchange between the remote control and the home electrical appliance via infrared rays, so that the grouped home electrical appliance is able to be controlled by the operation command triggered by the remote control.

Accordingly, this disclosure is directed an interior distributing system and a method for an interior distributing system. Within a control area able to receive the signals the controller transmits, the home electrical appliances are able to be controlled by the signals the controller transmits in response to the remote control. Thus, this disclosure achieves a stable system and easy operation via a one-to-many operation thereof or further coordinating with radio-frequency sensor for auto-detection.

BRIEF DESCRIPTION OF THE DRAWINGS

This disclosure will become more fully understood from the detailed description given herein below for illustration only, and thus not limitative of this disclosure, wherein.

DETAILED DESCRIPTION

Figure 1:
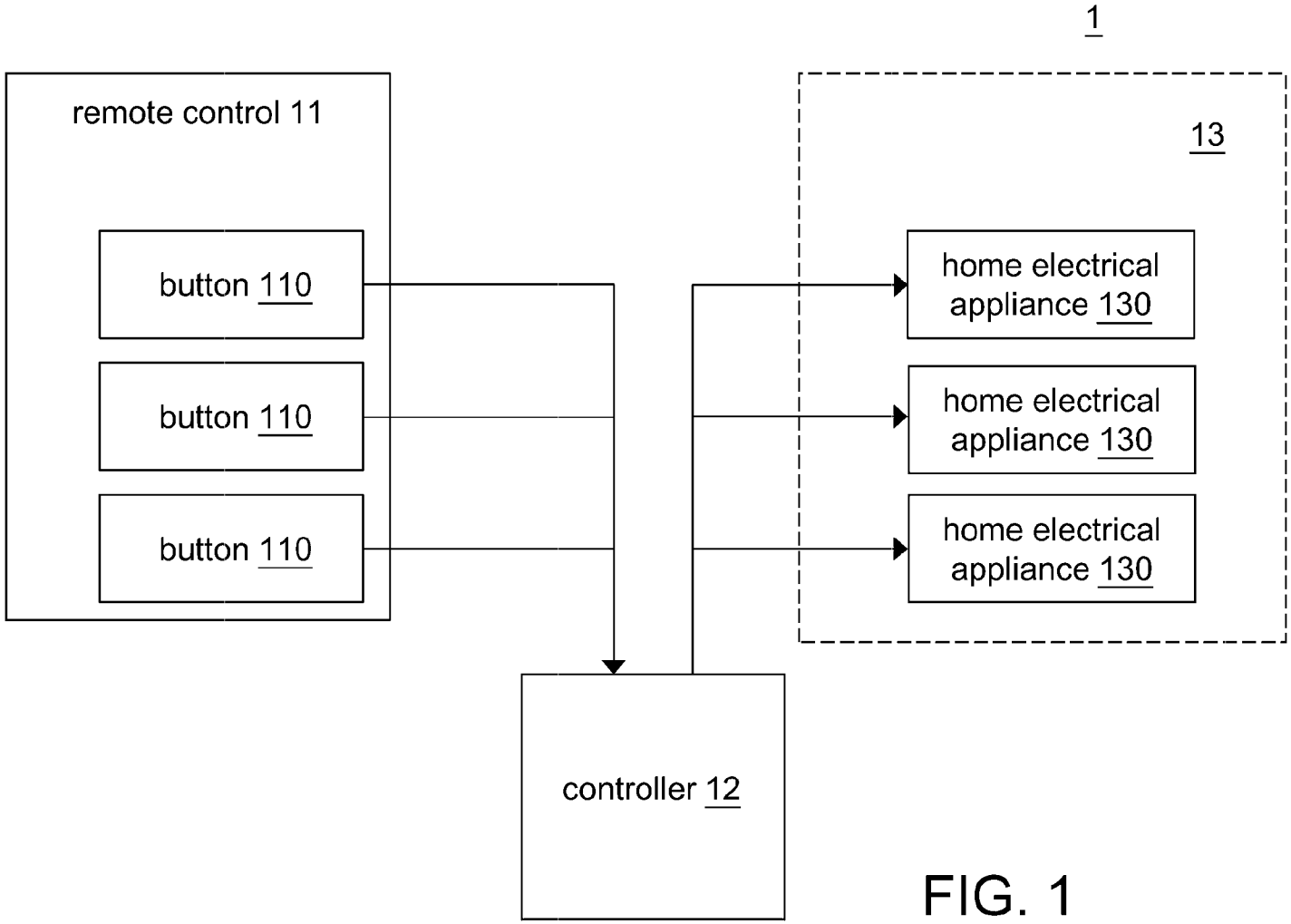
FIG. 1 is a schematic view of an interior distributing system in accordance with a first embodiment.

Please refer to FIG. 1, an interior distributing system 1 includes a remote control 11, a controller 12, and a least one home electrical appliance 130 to be controlled in accordance with a first embodiment. The home electrical appliance 130 may be any electrical appliance operating with electricity, such as a microwave oven, an electric pot, an electric oven in the kitchen or TV, an electric fan, an audio system, electrical illumination device in the living room. Moreover, the home electrical appliance 130 may also be a power switch, power socket for power supply. This disclosure is directed to use the remote control 11 to control these home electrical appliances 130 simultaneously in a smart, energy saving, and safe manner.

Please refer to FIG. 1, the remote control 11 includes a plurality of buttons 110. The buttons 110 is, but not limited to, a mechanical button or a touch button. Each of the buttons 110 is used for triggering a corresponding operation command 100. The operation command 100 is a command that the controller 12 communicates with and controls the home electrical appliance 130. Further, a data interchange is completed between the remote control 11 and the controller 12 via wireless transmission, such as infrared rays or NFC (Near Field Communication), or direct connection by plug-in connection, so that the controller 12, which is a control center of the interior distributing system 1, is able to receive the operation command 100 from the remote control 11. Furthermore, the home electrical appliances 130 are located within a control area 13 defined by signal receiving range of the home electrical appliance 130 from controller 12. The controller 12 is used to communicate all the home electrical appliances 130 within the control area 13. As a result, while the controller 12 receives the operation command 100 from the remote control 11, the controller 12 transmits the operation command 100 to the home electrical appliance 130, and the home electrical appliance 130 performs a process task in response to the operation command 100.

In the respect of the operation of the home electrical appliances 130 in response to the operation command 100, such as powering on-and-off the TV, the electrical illumination devices, the power switches, or enabling/disabling power supply of a power socket to indirectly power on-and-off the electrical appliances plugging in the power socket, the remote control 11 is set up to communicate with the controller 12, namely pairing; and then the controller 12 is able to receive and decode the operation command 100 issued by the remote control 11. One or more electrical appliances 130 may be set simultaneously in response to the remote control 11. For example, each of the buttons 110 of the remote control 11 can be used to control different group of electrical appliances 130. plural electrical appliances 130 in one group can be controlled by one corresponding button 110 (for example, simultaneously powered on-and-off by one of the buttons 110). In one example, a data interchange is completed between the remote control 11 and the controller 12 via, including but not limited to, wireless transmission (radio frequency, RF).

The home electrical appliances 130 are controlled by the controller 12 rather by the remote control 11 directly.

Therefore, the controlled range will not be limited to the signal transmitting range of the remote control 11 but be determined by the control area 13 defined by the signal receiving range between the controller 12 and the home electrical appliances 130. The controller 12 in the control area 13 transmits and connects with the home electrical appliances 130 via wireless transmission or power lines. In condition that wireless transmission is utilized to connect controller 12 with the home electrical appliances 130, the control area 13 is able to be expanded via a repeater. Thus, this disclosure is directed a remote interior distributing system 1 to one or more home electrical appliances 130.

Figure 2:
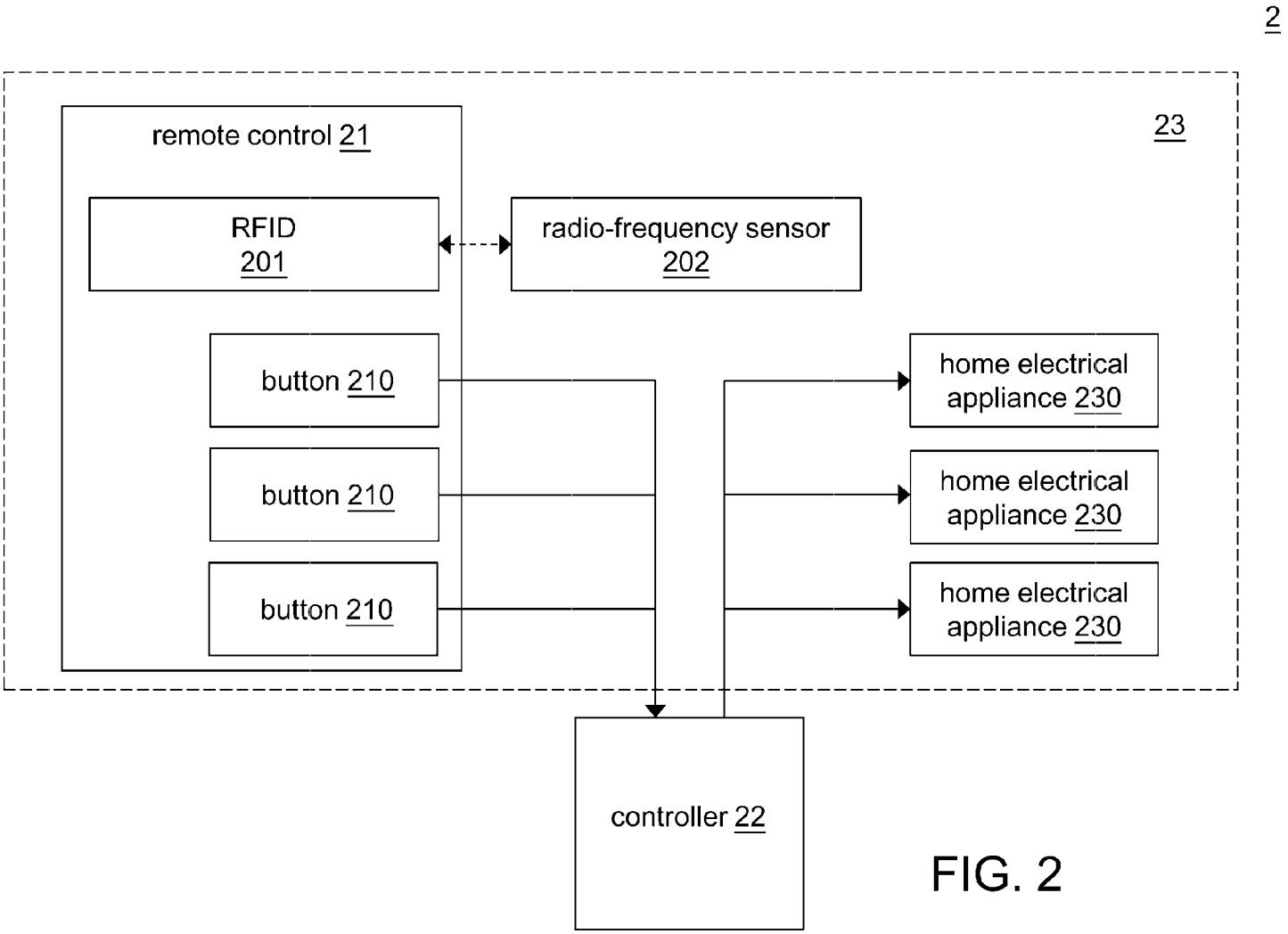
FIG. 2 is a schematic view of an interior distributing system in accordance with the first embodiment.

Please refer to FIG. 2, a second embodiment of this disclosure is directed an auto-detected interior distributing system 2. The different matter from the first embodiment is it is able to detect use's move automatically, instead of manual operation, and turn the electrical appliances on or off accordingly.

Please refer to FIG. 2, in the second embodiment, the interior distributing system 2 further includes a radio frequency identification tag (RFID) 201 and at least one radio-frequency sensor 202 for detecting the FID 201. The remote control 21 includes the RFID 201. The audio-frequency sensor 202 is disposed within the control area 23 of the home electrical appliances 230. The radio-frequency sensor 202 detects the RFID 201 of the remote control 21, such that controller 22 receives the operation command while the RFID 201 entering the reading range of the radio-frequency sensor 202.

Please refer to FIG. 2, the remote control 21 includes a plurality of buttons 210, and each of the buttons 210 is used for trigging a corresponding operation command. The operation command 200 is a command that the controller 22 communicates with and control the home electrical appliance 230. Furthermore, a data interchange is completed between the remote control 21 and the controller 22 via wireless transmission, such as infrared rays or NFC, or direct connection by plug-in connection, so that the controller 22, which is a control center of the interior distributing system, is able to receive the operation command 200 from the remote control 21. Furthermore, the home electrical appliances 230 are located within a control area 23 which is able to receive the signal that the controller 22 transmits. The radio-frequency sensor 23 for detecting the RFID 201 is disposed in the control area 23. While radio-frequency sensor 230 detects the RFID 201 of the remote control 21, the controller 22 is able to transmit the operation command 200 to the home electrical appliances 230, and controls the home electrical appliances 230 to process a task in response to the operation command 200.

Notably, the control area 23 is the signal receiving range that each of the home electrical appliances 230 is able to receive signals from the controller 22. In other word, the control area 23 is defined by the signal receiving range of the home electrical appliance 230 from the controller 22. The connection and the signal transmission between the home electrical appliance 230 and the controller 22 are achieved by wireless transmission, infrared rays or power lines. In condition that wireless transmission is utilized to connect controller 12 with the home electrical appliances 130, the control area 23 is able to be expanded via a repeater. By contrast, the detecting area of the RFID 201 and the radio-frequency sensor 202 is defined by the range the radio-frequency sensor 202 detects the RFID 201. In the event the RFID 201 enters the detected region of the radio-frequency sensor 202, the controller 21 transmits the operation command 200 to the home electrical appliances 230 in the control area 23 to process a task in accordance with the operation command 200 the remote control 21 presets.

When the user carrying the remote control 21 approaches the living room, the radio-frequency sensor 202 in the living room detects the RFID 201 of the remote control 21, and the controller 22 automatically controls the electrical illumination device or TV to be powered-on. In the second embodiment, about the operation of controlling the home electrical appliances 230 to process a task in accordance with the operation command 200, the remote control 21 and the controller 22 have to be paired in advance so that the controller 22 is able to store the preset operation command 200 corresponding to the remote control 21 and then sending the operation command accordingly when the RFID 201 enters the detecting area of the radio-frequency sensor 202.

The operation command 200 is command that is preset for the controller 22 to control the home electrical appliance 230. A data interchange is completed between the remote control 21 and the controller 22 via wireless transmission, such as infrared rays or NFC, or direct connection by plug-in connection. The home electrical appliance 230 may be an electrical appliance, such as TV, electrical illumination devices to be powered on-and-off directly. The home electrical appliance 230 may also be a power switch or a power socket to indirectly power on-and-off the electrical appliances connected thereto bt enabling/disabling power supply.

Regarding function setting in an example of this disclosure, a data interchange is completed between the remote control 11, 21 and the controller 12, 22 via infrared rays, so that the controller 12, 22 is able to confirm the validity of the operation command 100, 200 transmitted via the synchronous operation. Furthermore, the data interchange completed via infrared rays is also used to group plural home electrical appliances with the remote control 12, 22, so as to control the home electrical appliances by the operation command 100, 200 transmitted from the controller 12, 22. The remote control 11, 21 includes an infrared ray transmitter for grouping process of the home electrical appliances 130, 230, while each of the home electrical appliances 130, 230 includes an infrared ray receptor for receiving the grouping instruction from the remote control 11, 21. One operation command 100, 200 transmitted by the remote control 11, 21 is able to control on-and-off of the one or more home electrical appliances 130, 230 in one group simultaneously.

Figure 3:
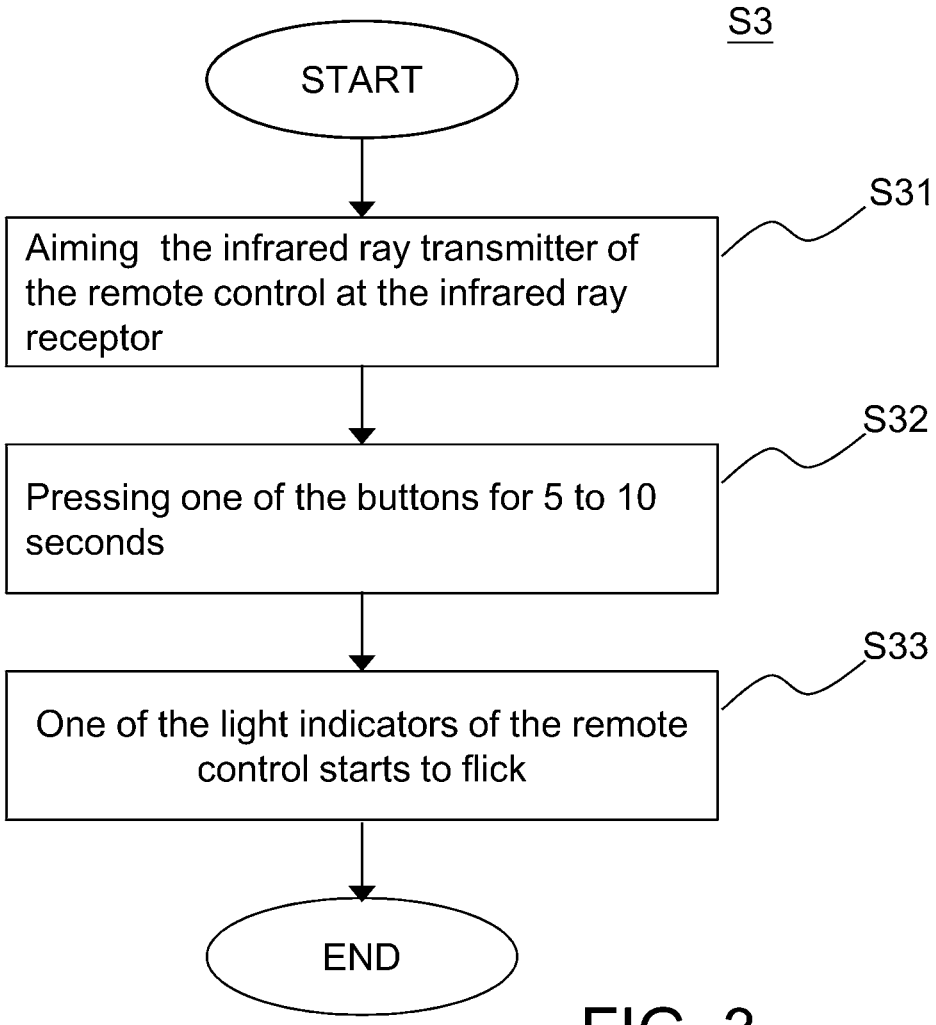
FIG. 3 is a flowchart of the synchronous operation.

Please refer to FIG. 3, which shows the synchronous operation process (S3) of the remote control 11, 21.

Firstly, the user has to aim the infrared ray transmitter of the remote control 11, 21 at the infrared ray receptor (S31) of the controller 12, 22, and then press one of the buttons 110, 210 for 5 to 10 seconds (S32). When one of the light indicators of the remote control 11, 21 starts to flick, the synchronous operation process has been done (S33).

In a case of canceling the synchronous operation, on the contrary, the user has to aim the infrared ray transmitter of the remote control 11, 21 at the infrared ray receptor S31 of the controller 12, 22 again, and then press one of the buttons 110, 210 for 5 to 10 seconds again as the foregoing process. When one of the light indicators of the remote control 11, 21 starts to flick, the synchronous operation has been canceled.

Figure 4:
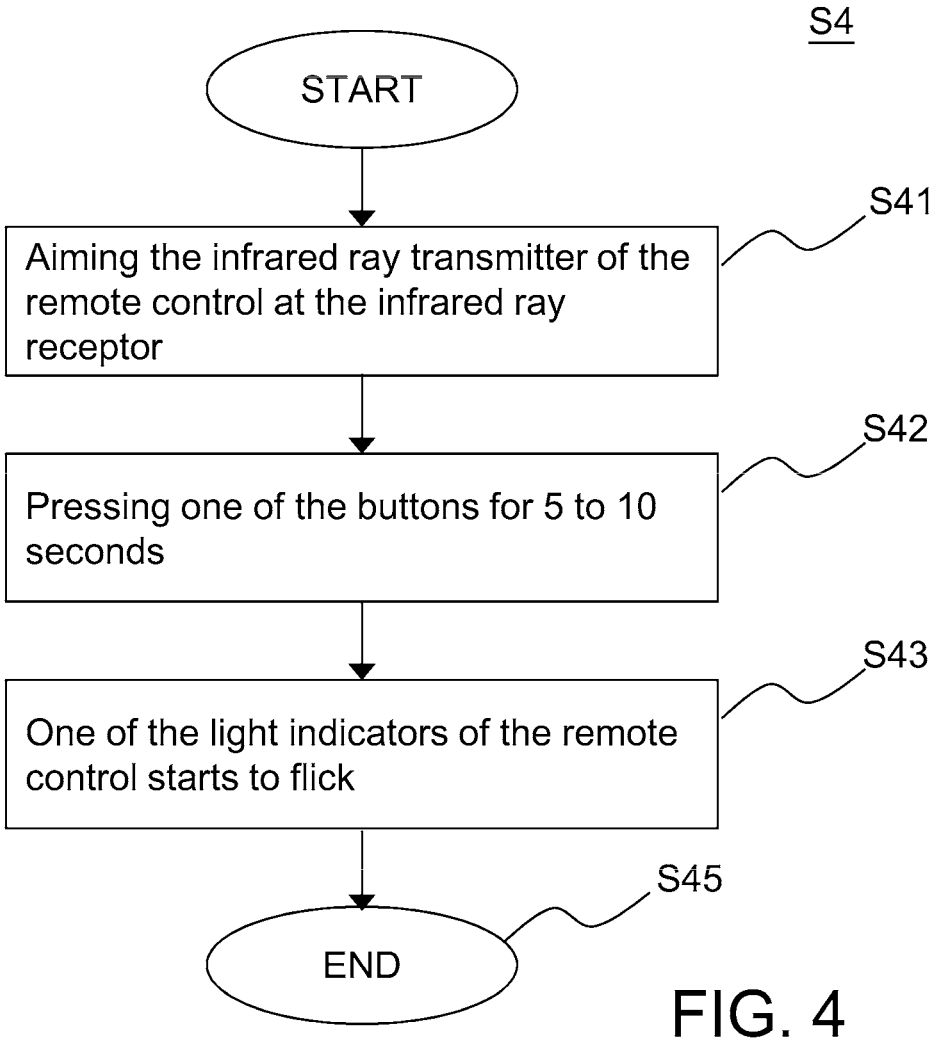
FIG. 4 is a flowchart of a grouping operation.

Please refer to FIG. 4, which shows the grouping operation process (S4) of the remote control 11, 21.

Firstly, the user has to aim the infrared ray transmitter of the remote control 11, 21 at the infrared ray receptor (S41) of the home electrical appliances 130, 230, and then press one of the buttons 110, 210 for 5 to 10 seconds (S42). When one of the light indicators of the remote control 11, 21 starts to flick, the grouping operation process has been done (S43).

In a case of canceling the grouping operation, on the contrary, the user has to aim the infrared ray transmitter of the remote control 11, 21 at the infrared ray receptor of the controller 12, 22 again, then and press one of the buttons 110, 210 for 5 to 10 seconds again as the foregoing process. When one of the light indicators of the remote control 11, 21 starts to flick, the grouping operation has been canceled.

In addition to the control of the home electrical appliance 130, 230, the remote control 11, 21 receives the operation status of the home electrical appliance 130, 230 to monitor the home electrical appliance 130, 230. The remote control 11, 21 receives the operation status of the home electrical appliances 130, 230 via the controller 12, 22. The operation status of the home electrical appliances 130, 230 are shown on the remote control 11, 21. When the home electrical appliances 130, 230 is turned on, the user who is at other places is able to understand the home electrical appliances 130, 230 has been turned on via the remote control 11, 21. In one example, a data interchange between the remote control 11, 21 and the controller 12, 22 is completed via wireless transmission; wherein the data is, including but not limited to, operation status of the home electrical appliance 130, 230.

Figure 5:
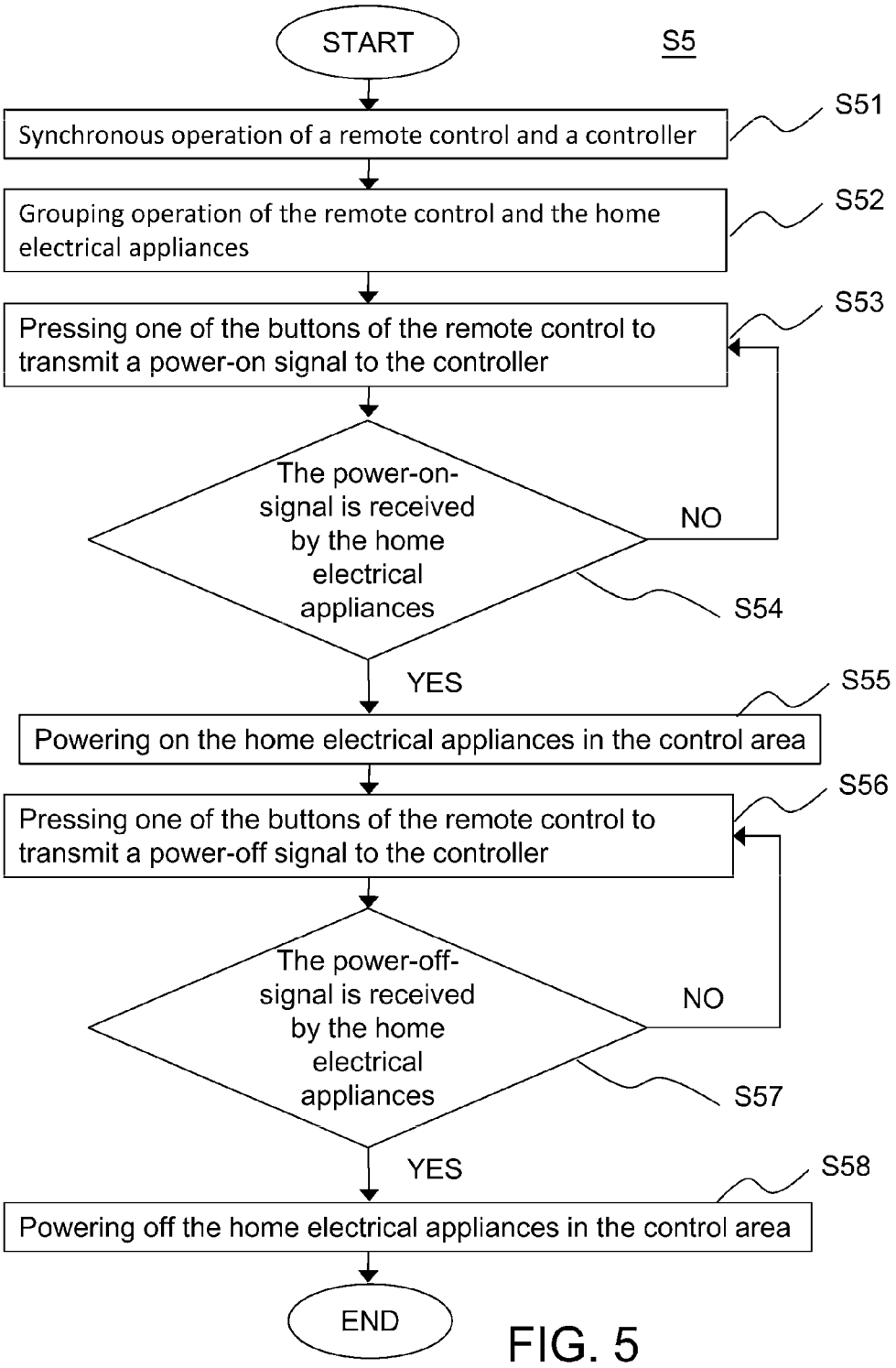
FIG. 5 is a flowchart of the controlling method in accordance with the third embodiment.

Please refer to FIG. 5, which shows a method for an interior distributing system (S5) in accordance with a third embodiment of this disclosure.

Firstly, a synchronous operation of a remote control 11, 21 and a controller 12, 22, is processed to confirm the validity of the operation command 100, 200 of the remote control 11, 21 (S51). Then, the grouping operation (S52) of the remote control 11, 21 and the home electrical appliances 130, 230 in the control area 13, 23 is processed, so that the grouped electrical appliances 130, 230 is able to be controlled by the operation command 100, 200.

To powering on the grouped electrical appliances 130, 230, the user presses one of the buttons 110, 210 of the remote control 11, 21, the remote control 11, 21 transmits a power-on signal 501 to the controller 12, 22 (S53) for the purpose of powering one the home electrical appliances 130, 230. At this time, the controller 12, 22 transmits the power-on signal 501 to the home electrical appliances 130, 230 and determines if the power-on-signal 501 the controller 12, 22 transmits is received by the home electrical appliances 130, 230 (S54). If the power-on-signal 501 is received by the home electrical appliances 130, 230, the home electrical appliances 130, 230 in the control area 13, 23 is powered on (S55).

To powering off the grouped electrical appliances 130, 230, the user presses one of the buttons 110, 210 of the remote control 11, 21, and then the remote control 11, 21 transmits a power-off signal 502 to the controller 12, 22 (S56) for the purpose of powering off the one or more home electrical appliances 130, 230. At this time, the controller 12, 22 transmits the power-off signal 502 to the home electrical appliances 130, 230 and determines if the power-off-signal 502 the controller 12, 22 transmits is received by the home electrical appliances 130, 230 (S57). If the power-off signal 502 is received by the home electrical appliances 130, 230, the home electrical appliances 130, 230 in the control area 13, 23 is powered off (S58) and the control process is terminated.

Accordingly this disclosure is directed an interior distributing system and a method for an interior distributing system the home electrical appliances, in which the interior distributing system and the method are able to control plural home electrical appliances simultaneously in a pre-determined region, the remote control communicates with the home electrical appliances via a controller. The user is able to power on/off the home electrical appliances via the remote control automatically or by manually. The remote control carried by the user can be detected as well. Hence, an easy-to-use and stable system and a method are disclosed.

What is claimed is:

1. An interior distributing system, comprising:

a remote control including a radio frequency identification tag and a button for being pressed to trigger the remote control transmitting an operation command;

a controller receiving the operation command from the remote control;

at least one home electrical appliance located within a control area and being able to receive the operation command from the controller; and a radio frequency sensor disposed within the control area, communicating with the controller, and detecting the radio frequency identification tag of the remote control, wherein the radio frequency sensor detects the radio frequency identification tag of the remote control entering a reading range of the radio-frequency sensor, and transmits a trigger command to the controller, while the controller transmits the operation command to the at least one home electrical appliance within the control area to control the at least one home electrical appliance within the control area in response to the operation command.

2. The interior distributing system as claimed in claim 1, wherein the operation command is a command that the controller communicates with and controls the home electrical appliance.

3. The interior distributing system as claimed in claim 1, wherein the button is a mechanical button or a touch button.

4. The interior distributing system as claimed in claim 1, wherein a data interchange is completed between the remote control and the controller via wireless transmission.

5. The interior distributing system as claimed in claim 1, wherein a data interchange between the remote control and the controller is completed via wireless transmission, and the data includes operation status of the home electrical appliance.

6. The interior distributing system as claimed in claim 1, wherein a data interchange is completed between the remote control and the controller via infrared rays, touch sensors or plug-in connection.

7. The interior distributing system as claimed in claim 1, wherein the control area is defined by a signal receiving range of the home electrical appliance from controller.

8. The interior distributing system as claimed in claim 1, wherein the control area is expanded via a repeater.

9. The interior distributing system as claimed in claim 1, wherein the home electrical appliance is a power switch, a power socket or an electrical device on a loop of electricity supply.

10. The interior distributing system as claimed in claim 1, wherein the connection and the transmission between the home electrical appliance and the controller are via wireless transmission, infrared rays or power lines.

11. A method for controlling an interior distributing system comprising at least one home electrical appliance and a radio frequency sensor within a control area, comprising:

synchronizing a remote control and a controller, wherein the remote control includes a button and a radio frequency identification tag;

grouping the remote control and the at least one home electrical appliance;

pressing the button of the remote control to trigger the remote control transmitting an operation command;

receiving the operation command by the controller from the remote control;

entering a reading range of the radio-frequency sensor by the remote control having the radio frequency identification tag;

detecting the radio frequency identification tag of the remote control by the radio frequency sensor;

transmitting a trigger command to the controller from the radio frequency sensor; and transmitting the operation command to the at least one home electrical appliance within the control area by the controller to control the at least one home electrical appliance in response to the operation command.

12. The method as claimed in claim 11, wherein the step of synchronizing the remote control and the controller is to complete a data interchange between the remote control and the controller via infrared rays, so that the controller is able to confirm the validity of the operation command transmitted from the controller.

13. The method as claimed in claim 11, wherein the step of grouping the remote control and the home electrical appliance is to complete a data interchange between the remote control and the home electrical appliance via infrared rays, so that the grouped home electrical appliance is able to be controlled by the operation command triggered by the remote control.

* * * * *